US009486667B2

(12) United States Patent
Kimura

(10) Patent No.: US 9,486,667 B2
(45) Date of Patent: Nov. 8, 2016

(54) BICYCLE TRAINER

(71) Applicant: Masayuki Kimura, Kanagawa (JP)

(72) Inventor: Masayuki Kimura, Kanagawa (JP)

(73) Assignee: Masayuki Kimura (JP)

( * ) Notice: Subject to any disclaimer, the term of this patent is extended or adjusted under 35 U.S.C. 154(b) by 66 days.

(21) Appl. No.: 14/380,676

(22) PCT Filed: Feb. 21, 2013

(86) PCT No.: PCT/JP2013/054308

§ 371 (c)(1),
(2) Date: Aug. 22, 2014

(87) PCT Pub. No.: WO2013/125627

PCT Pub. Date: Aug. 29, 2013

(65) Prior Publication Data

US 2015/0011364 A1 Jan. 8, 2015

(30) Foreign Application Priority Data

Feb. 23, 2012 (JP) ..... 2012-037881

(51) Int. Cl.

*A63B 69/16* (2006.01)
*A63B 22/06* (2006.01)
*A63B 26/00* (2006.01)

(52) U.S. Cl.

CPC ..... *A63B 22/0605* (2013.01); *A63B 69/16* (2013.01); *A63B 26/003* (2013.01); *A63B 2069/162* (2013.01); *A63B 2069/165* (2013.01)

(58) Field of Classification Search

CPC ..... A63B 69/16; A63B 2069/161; A63B 2069/164; A63B 2069/166; A63B 2069/167; A63B 2069/168; F16F 1/40; F16F 1/403; F16F 1/406; F16F 1/41

See application file for complete search history.

(56) References Cited

U.S. PATENT DOCUMENTS 1,139,732 A * 5/1915 Slick ..... B60G 11/00 267/165
2,551,505 A * 5/1951 Olson, Jr. ..... F16F 1/406 267/140.4
4,494,662 A * 1/1985 Clymer ..... A63B 21/023 482/123
5,816,818 A * 10/1998 Wun ..... A63B 22/0605 434/29

(Continued)

FOREIGN PATENT DOCUMENTS

JP 257947 B2 12/1990
JP 3046083 U 2/1998

(Continued)

OTHER PUBLICATIONS

English translation of Written Opinions of the International Searching Authority date of mailing Apr. 23, 2013 for PCT/JP2013/054308 (6 pages).

(Continued)

*Primary Examiner* — Loan H Thanh
*Assistant Examiner* — Rae Fischer
(74) *Attorney, Agent, or Firm* — Fitch Even Tabin & Flannery LLP

(57) ABSTRACT

Provided is a bicycle trainer that provides a riding sensation such as that when actually riding a bicycle outdoors. The bicycle trainer is for training by using a detachably installed bicycle (21) and is provided with the following: a main body (3) placed on the floor; a support shaft (5) in which one end is movably inserted into the main body and the other end is fixed to a fork end support means (7) that supports a fork end part (23) of the bicycle; and an elastic part disposed so as to surround at least a part of the support shaft from the center in the longitudinal center thereof to the other end. The support shaft elastically deforms due to the force imparted from the fork end part and therefore the bicycle can move forward and backward and incline to the left and right.

6 Claims, 5 Drawing Sheets

(56) References Cited

U.S. PATENT DOCUMENTS

| | | | |
|---|---|---|---|
| 6,056,672 | A | 5/2000 | Tendero |
| 6,126,577 | A | 10/2000 | Chang |

FOREIGN PATENT DOCUMENTS

| | | | |
|---|---|---|---|
| WO | 2002062426 | A1 | 8/2002 |
| WO | 2007/083341 | A1 | 7/2007 |

OTHER PUBLICATIONS

Written Opinion date of mailing Apr. 23, 2013 for PCT/JP2013/054308 (10 pgs). (Not in English).
International Search Report date of mailing Apr. 23, 2013 for PCT/JP2013/054308 (2pgs).
Supplementary European Search Report date of mailing Sep. 2, 2015 for EP 13751538.3 (6 pages).

* cited by examiner

BICYCLE TRAINER

CROSS-REFERENCE TO RELATED APPLICATIONS

This application is a U.S. national phase application filed under 35 U.S.C. §371 of International Application PCT/JP2013/054308, filed on Feb. 21, 2013, designating the United States, which claims priority from Japanese Application Number 2012-037881, filed Feb. 23, 2012, which are hereby incorporated herein by reference in their entirety.

FIELD OF THE INVENTION

The present invention relates to a bicycle trainer capable of performing training using a real bicycle that runs outdoors, and more particularly, to such a bicycle trainer to which the bicycle, from which its wheel is detached, is mounted for training.

BACKGROUND ART

There have been proposed various kinds of bicycle trainers to promote health or to enhance endurance by exercising or performing pedaling activities of bicycles indoors. Even among them, following examples are such bicycle trainers as to perform training by mounting bicycles on which people ride outdoors by themselves to obtain similar feeling and riding positions as those of actual running outdoors.

For example, as shown in FIG. 8, there is a publicly known bicycle trainer 60 that comprises a frame 62 capable of attaching a bicycle which its front wheel is removed from, wherein the frame 62 has a roller 64 which rolls in contact with a tire 74 for a back wheel of the bicycle, and a resistance grant part 66 to apply a resistance to the roller 64 (see Japanese Patent Publication No. hei2-57947 gazette).

Moreover, as shown in FIG. 9, there has been developed a bicycle training device 80 that comprises a main body part 82 which enables to make it stable on the ground, wherein the main body part 82 has a frame end fixing part 85 that fixedly support a front frame end part 95 of a bicycle 91 from which its rear wheel is taken off, a rotation body 84 which is linked to a drive unit 92 of the bicycle 91 and rotates in accordance with the drive unit 92, and a rotation control body 88 which controls a rotation of the rotation body 84 (see Japanese Patent Republication No. 2002-062426 gazette). In terms of the bicycle training device 80, a front wheel of the bicycle 91 is detached from the fork end part 95 with a pub and is fixedly supported to the fork end fixing part 85.

SUMMARY OF THE INVENTION

An invention described in the patent document 1 may change a braking force which is applied to a braking disk 68 in a wide range from a state of none at all to a state of receiving a predetermined braking force. However, the bicycle trainer 60 that is configured a front fork end part 75 of the bicycle to be fixedly supported with a fork clamper 65 provided at a front rising portion 63 of the frame 62 had a problem that lacks a feeling of actual riding such as when actually operating a bicycle outdoors because it does not move in the forward and backward directions nor slant in the right and left direction as when actually operating a bicycle.

An invention described in the patent document 2 also has similar configuration to that of the patent document 1, wherein the front fork end part 95 of the bicycle 91 supplied thereto is fixedly supported to the main body part 82 via the fork end fixing part 85. It does not yet solve a problem that lacks a feeling of riding such as when actually operating a bicycle outdoors.

The object of the present invention is, therefore, to provide a bicycle trainer to offer a comfortable ride like actually operating a bicycle outdoors.

To achieve above object, a bicycle trainer according to the present invention is characterized by a bicycle trainer to enable a user to train with use of a bicycle (21) removably loaded on the bicycle trainer comprising: a body part (3) placed on a floor; a support shaft (5), one end thereof being loosely inserted into the body part and the other end thereof being fixed to a fork end support unit (7) to support a fork end part (23) of the bicycle; and an elastic part (9) arranged around at least a portion of the support shaft between a center in a longitudinal direction thereof to the other end, and wherein the support shaft is elastically deformed by force applied from the fork end part so as to allow the bicycle back and forth movement and left and right inclination.

In the bicycle trainer of the present invention, the support shaft is elastically deformed by the force applied from the fork end part because the upper portion of the support shaft, of which the one end is loosely inserted into the body part and the other end is fixed to a fork end support unit, is surrounded by the elastic part. Therefore, a user can bodily feel swing of the bicycle in back and forth movement and left and right inclination in corresponding to the force applied to the bicycle.

The bicycle trainer according to the present invention preferably comprises a frame part (11) internally having a tubular space and vertically arranged to the body part, wherein an elastic part is formed in the tubular space of the frame part, the support shaft is inserted into the tubular space through the elastic part along the longitudinal direction of the frame part, and the other end of the support shaft is extended from the frame part.

According to this configuration, aesthetic appearance of the bicycle trainer is improved because the support shaft is arranged within the frame part. Moreover, swing of the support shaft in back and forth movement and left and right inclination is restricted within a fixed range because the elastic part is formed in the tubular space of the frame part. Therefore a maximum swing angle in back and forth movement and left and right inclination of the bicycle may be restricted within a fixed range to allow restriction to a maximum angle during actual riding.

In the above-described embodiment, the support shaft is preferably a steel rod or a steel pipe. The above constitution allows an increase in strength of the bicycle trainer and also an improvement in performance of swinging the bicycle in all directions because the support shaft of a steel rod or a steel pipe increases in intensity and is also elastic.

In the above-described embodiment, the support shaft contains an elastic member having elasticity. As the elastic member having the elasticity, for example, a spring may be employed. The above constitution allows a moderate adjustment of swinging of the bicycle in all directions.

In the above-described embodiment, the support shaft has a support shaft part in which the elastic member and a joint part composed of a non-elastic member are alternately connected. According to this configuration, the support shaft having different modulus of elasticity depending on a site in the longitudinal direction can be obtained, and therefore swing of the bicycle in all directions can be further finely adjusted. Here, a non-elastic member includes a member substantially having no elasticity, a metallic material, for instance.

In addition, in the above-described embodiment, elasticity modulus of elastic materials constituting the elastic members successively decrease from one end of the support shaft to the other end. This constitution allows the bicycle to provide with larger front and back or left and right swing when a same force is applied onto a side to the body part of the support shaft.

According to a bicycle trainer of the present invention, wherein the upper portion of the support shaft, of which one end is loosely inserted into the body part and the other end is fixed to a fork end support unit, is surrounded by the elastic part, and the support shaft is elastically deformed by the force applied from the fork end part, a user can bodily feel swing of the bicycle in back and forth movement and left and right inclination in corresponding to the force applied to the bicycle.

DETAILED DESCRIPTION OF THE PREFERRED EMBODIMENTS

Referring to the accompanying drawings, embodiments of the present invention will be explained in detail as follows. In addition, the present invention is not limited by the following examples.

Example 1

Figure 1:
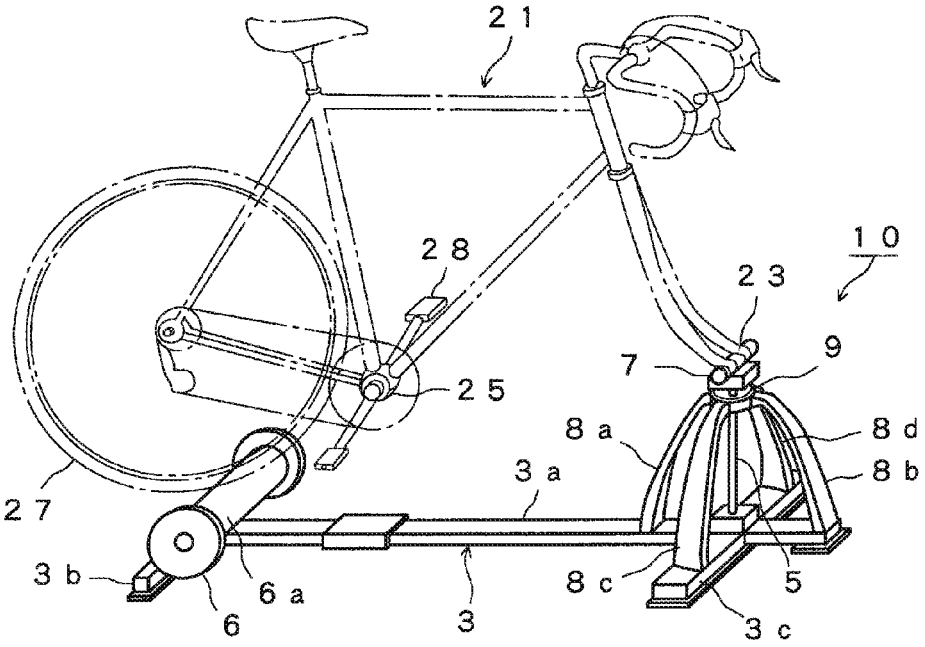
FIG. 1 is an explanatory view showing a bicycle trainer expressed in Example 1.

FIG. 1 shows a bicycle trainer 10 of Example 1. As shown in FIG. 1, a body part 3 of the bicycle trainer 10 comprises a front-rear direction rod 3*a* spreading horizontally in the forward and backward direction, a rear leg 3*b* spreading in the right and left direction at the rearward portion of the front-rear direction rod 3*a*, and a front leg 3*c* spreading in the right and left direction at the frontward of the front-rear direction rod 3*a*. On the rearward portion of the front-rear direction rod 3*a*, a rotary unit 6 is mounted so as to roll in contact with an outer peripheral surface of a rear wheel 27 of a bicycle 21. The rotary unit 6 comprises a roller member 6*a* having a predetermined outer diameter and is supported on the body part 3 via a suitable bracket (not shown in the Figure).

A support shaft 5 is in the shape of a rod. One end thereof is inserted in a hole (not shown in the Figure) provided in a support shaft fitting base (not shown in the Figure) fixed on the front-rear direction rod 3*a*, and the other end thereof is fixed to a fork end support unit 7. A fork end part 23 of the bicycle 21, from which a front wheel is taken off, is fitted to the fork end support unit 7 so that the bicycle 21 is mounted on the bicycle trainer 10.

As described above, at a part near to the other end (upper end) in the longitudinal direction of the support shaft 5, an outer peripheral surface thereof is surrounded with an elastic part 9, which is made of an elastic material such as a natural rubber or a synthetic rubber. In the present example, a top cross-sectional view of the elastic part 9 is in an annular shape, and an inter peripheral surface thereof is in contact with the outer peripheral surface of the support shaft 5, an outer peripheral surface thereof being in contact with an inner peripheral surface of a short metal tube (approximately 2 to 3 centimeters, not shown in the Figure). The metal tube is mounted above the body part 3 by means of four fixing members 8*a*, 8*b*, 8*c*, 8*d* which are respectively fixed on a front part of the front-rear direction rod 3*a* or on the front leg 3*c*. The support shaft 5 is a stainless steel pipe in this Example.

The operation from the above described constitution of the present invention will be described below illustrating a method of use of the bicycle trainer 10.

The bicycle trainer 10 is one for a user to perform a training by means of applying load to a pedal 28 of the bicycle 21, from which at least its front wheel is taken off, mounted thereon, and the body part 3 is stably placed on an indoor floor face, for example.

When the bicycle 21 is loaded on the bicycle trainer 10, the front wheel of the bicycle 21 is firstly detached from the fork end part 23 together with its pub and the fork end part 23 is fixedly supported to the fork end support unit 7. Then, the rear wheel 27 is put on a roller member 6*a* of the rotary unit 6 which is mounted to the rearward portion of the bicycle trainer 10.

As described above, once the user pushes the pedal 28 of the bicycle 21 which is mounted on the bicycle trainer 10, the rear wheel 27 starts rotating and the roller member 6*a* also starts rotating due to receiving a frictional force from the rear wheel 27. This applies loads to the pedaling such as the user actually runs on the bicycle 21.

In this manner, once the user starts driving the bicycle 21, a force is provided to a front wheel of the bicycle 21 to the forward direction, for example, because the rear wheel 27 receives a friction force from the roller member 6*a*.

This force pushes the support shaft 5 to bend forward, while the upper part (near the fork end support unit 7) of the support shaft 5 is enclosed in the elastic part 9 provided in a frame (a stainless steel pipe) fixed to the body part 3, and then a force to bend the support shaft 5 is restricted. Such a restricted force warps the support shaft 5 to a certain degree that the bicycle 21 is properly reclined forward. Likewise, once the user puts a force to decline the bicycle 21 to the left or right assuming turn to left or right, the force warps the support shaft 5 to a certain degree so that the bicycle 21 is properly reclined left or right.

As thus described, according to the bicycle trainer 10 of the present invention, when the user intends to move the bicycle 21 to the front, back, left and right, he or she enables the bicycle 21 to swing in back and forth movement and left and right inclination like actually running outdoors. And a degree of angle of the swing may be adjusted referring to the maximum declining angle when the bicycle 21 is in a straight-ahead running outdoors, for example, in order to become five (5) degree or the less against a straight line that is vertical to floor plane where the body part 3 is put, by a modulus (a vertical elasticity coefficient or a Young's modulus) of the elastic material comprising the elastic part 9, size of the elastic part 9, and a position where the support shaft 5 is set.

Example 2

Figure 2:
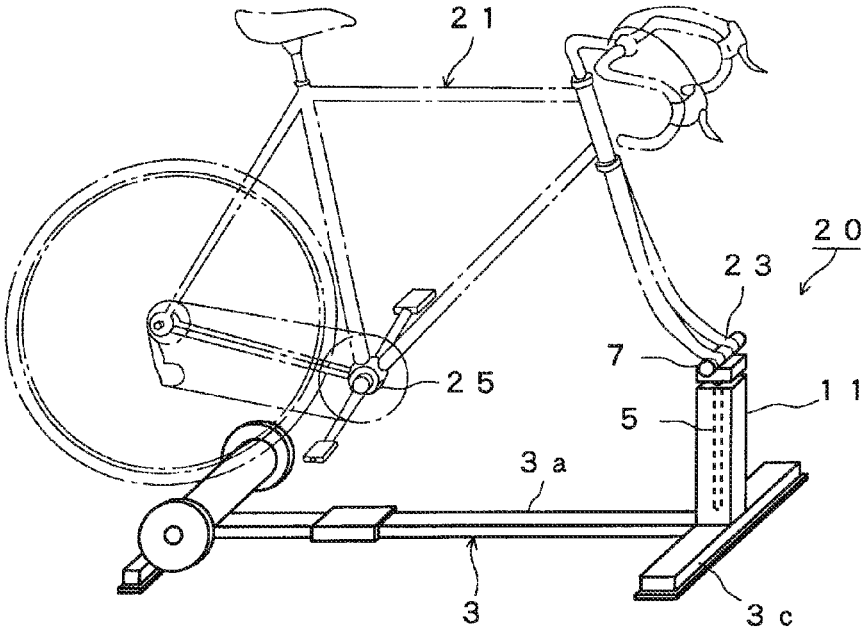
FIG. 2 is an explanatory view showing a bicycle trainer expressed in Example 2.

FIG. 2 shows a bicycle trainer 20 of Example 2. In the following examples, reference numerals refer to similar elements as those shown Example 1 and an overlapped explanation thereof will be omitted.

As shown in FIG. 2, the bicycle trainer 20 has a frame part 11 which is, unlike a case of Example 1, vertically fixed on the frontward of a front-rear direction rod 3*a*. The frame part 11 includes a pipe-shaped hollow part (not shown in the Figure), in which a support shaft 5 is arranged. The upper end (other end) of the support shaft 5 is extended from the frame part 11 and is fixed to a fork end support unit 7. And a fork end part 23 of the bicycle 21 is configured to be mounted to the fork end support unit 7 with a fork end nail (not shown in the Figure) similar to the case of Example 1.

Other structures are similar to those of the bicycle trainer 10 of Example 1.

Figure 3:
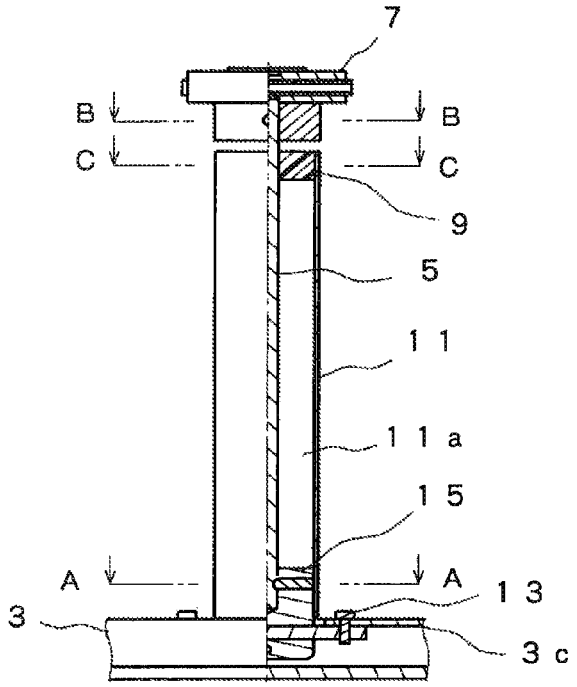
FIG. 3 is a one-side vertical-sectional view of a frame part and a fork end support unit of Example 2.

FIG. 3 is a one-side vertical-sectional view of the frame part 11 and the fork end support unit 7 of Example 2 from the viewpoint of the front (from right towards left on the sheet in FIG. 2). As shown in FIG. 3, the frame part 11 includes the pipe-shaped hollow part 11*a* inside, in which the support shaft 5 is located longitudinally in the center of the hollow part 11*a*. The lower part of the frame part 11 is inserted in a support shaft receiver 15 which is fixed on a front leg 3*c* with bolts 13, 13, and the upper part thereof is filled with an elastic part 9 having a predetermined thickness. The support shaft 5 passes completely through the elastic part 9 in the center thereof, and the upper end (other end) of the support shaft 5 is fixed to the fork end support unit 7. The lower side of the support shaft 5 is inserted in a hole 15*a* provided to the support shaft receiver 15 in a condition that the support shaft 5 enables to wave left and right and front and back. A material of the support shaft receiver 15 is aluminum and the support shaft 5 is composed of a cylindrical steel material made of stainless steel in this Example.

Figure 4:
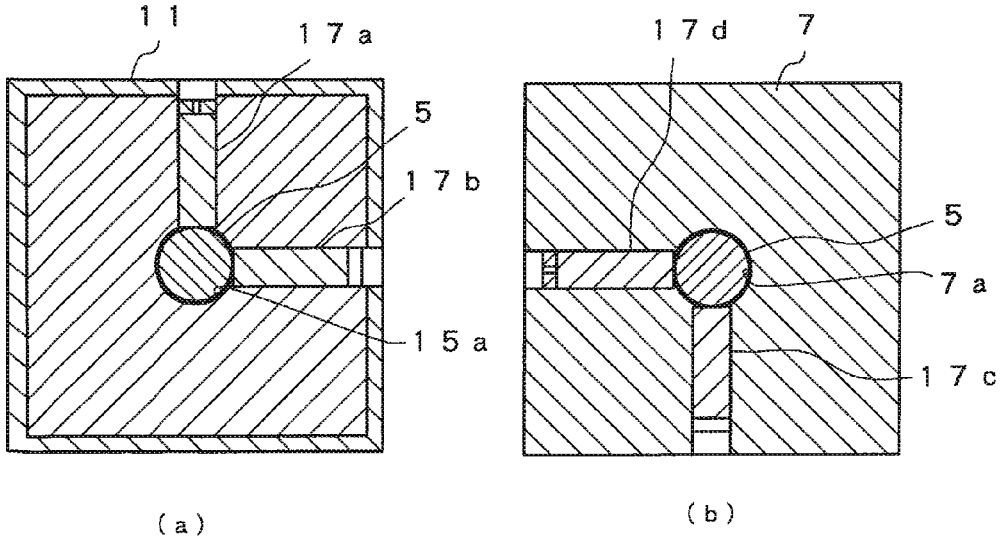
FIGS. 4(*a*) and (*b*) are sectional views taken along lines A-A and B-B of FIG. 3 respectively

FIGS. 4(*a*) and (*b*) are sectional views taken along lines A-A and B-B of FIG. 3 respectively.

As shown in FIG. 4(*a*), the frame part 11 is inserted into the support shaft receiver 15, and the support shaft 5 is inserted into a hole 15*a* provided in the center part of the support shaft receiver 15. A position of the support shaft 5 is adjustable depending on a degree of fastening of screws 17*a*, 17*b*.

As shown in FIG. 4(*b*), the lower part of the fork end support unit 7 has a quadrangular cross-section and a hole 7*a* is provided in the center part thereof. The upper part of the support shaft 5 is inserted in the hole 7*a*. A position of the support shaft 5 is adjustable depending on a degree of fastening of screws 17*c*, 17*d*.

Figure 5:
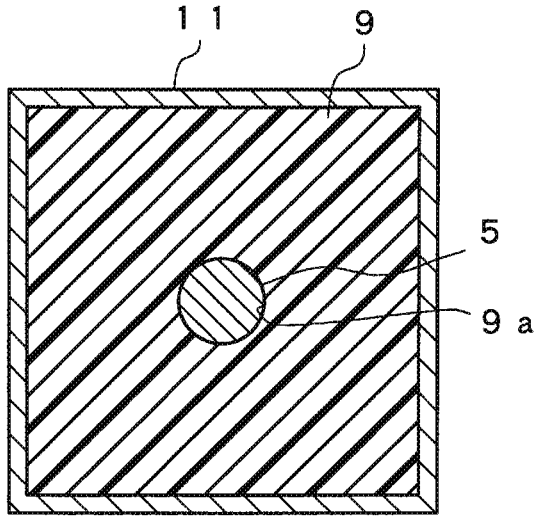
FIG. 5 is a sectional view taken along line C-C of FIG. 3.

FIG. 5 is a sectional view of FIG. 3 taken along line C-C. As shown in FIG. 5, the elastic part 9 is arranged at the upper part of the frame part 11 and a hole 9*a* is opened in the center of the elastic part 9. The support shaft 5 penetrates through the hole 9*a*. In the present example, an elastomer, an industrial material having rubber-like elasticity, is used as a material which the elastic part 9 is made of.

According to the bicycle trainer 20 of Example 2, it is configured the elastic part 9 to be arranged at the upper hollow part of the frame part 11 and the support shaft 5 to penetrate through the center thereof so that swing of the support shaft can be restricted within the interior of the frame part 11. In addition, the degree may be adjustable by selecting characteristics (for example, vertical elasticity coefficient or a Young's modulus) etc. of an elastic member comprising the elastic part 9.

Alternate Embodiment of Example 2

Figure 6:
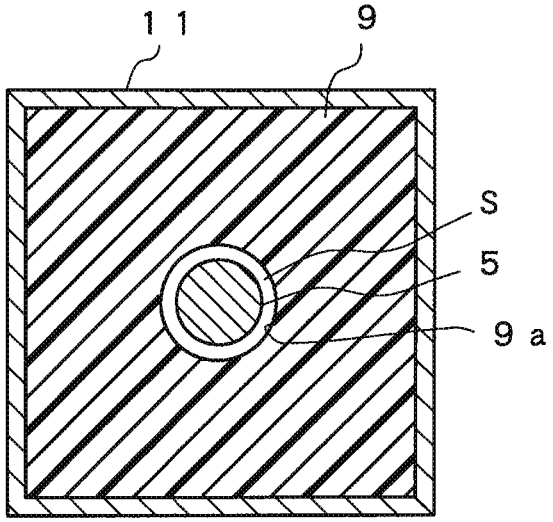
FIG. 6 is an upper part sectional view of a frame part related to an alternate embodiment.

As shown in FIG. 6, there may be a clearance S between the elastic part 9 and the support shaft 5, wherein the elastic part 9 and an outer peripheral surface of the support shaft 5 are not in contact each other. In this structure, a bending degree of the support shaft 5 is controlled with the elastic part 9.

Example 3

Figure 7:
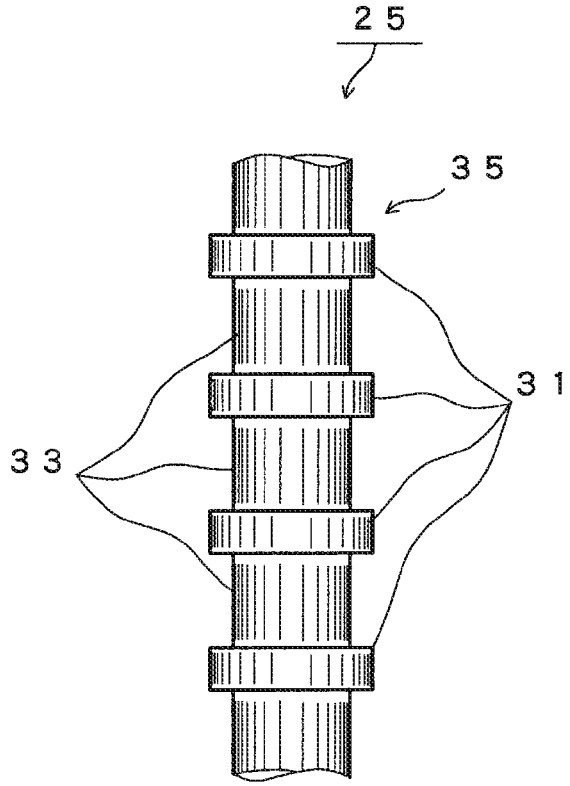
FIG. 7 is an explanatory view showing a part of a support shaft of a bicycle trainer expressed in Example 3.
Figure 8:
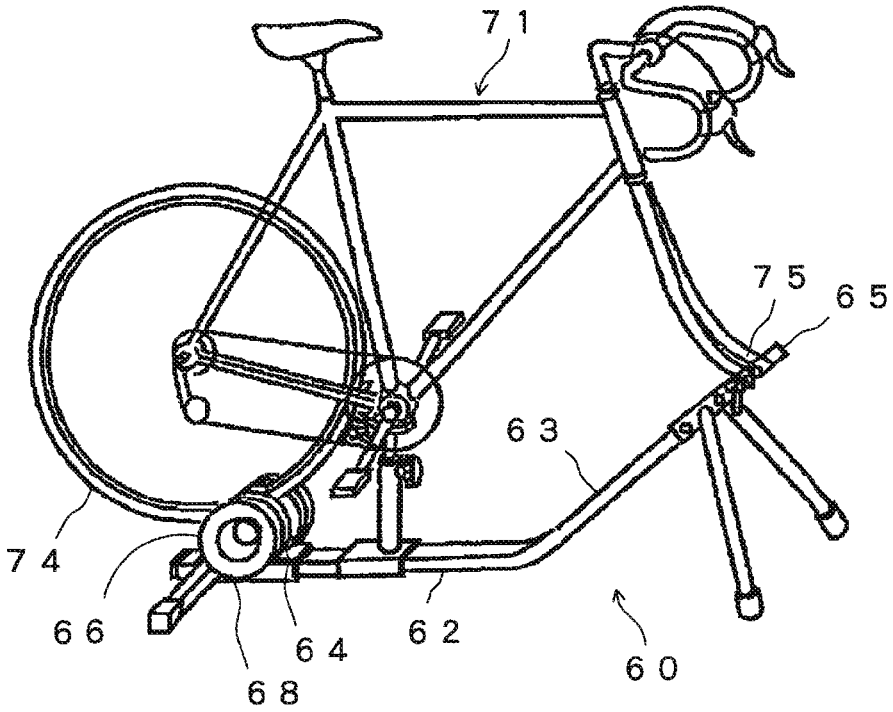
FIG. 8 PRIOR ART
FIG. 8 is an explanatory view to show conventional embodiment.
Figure 9:
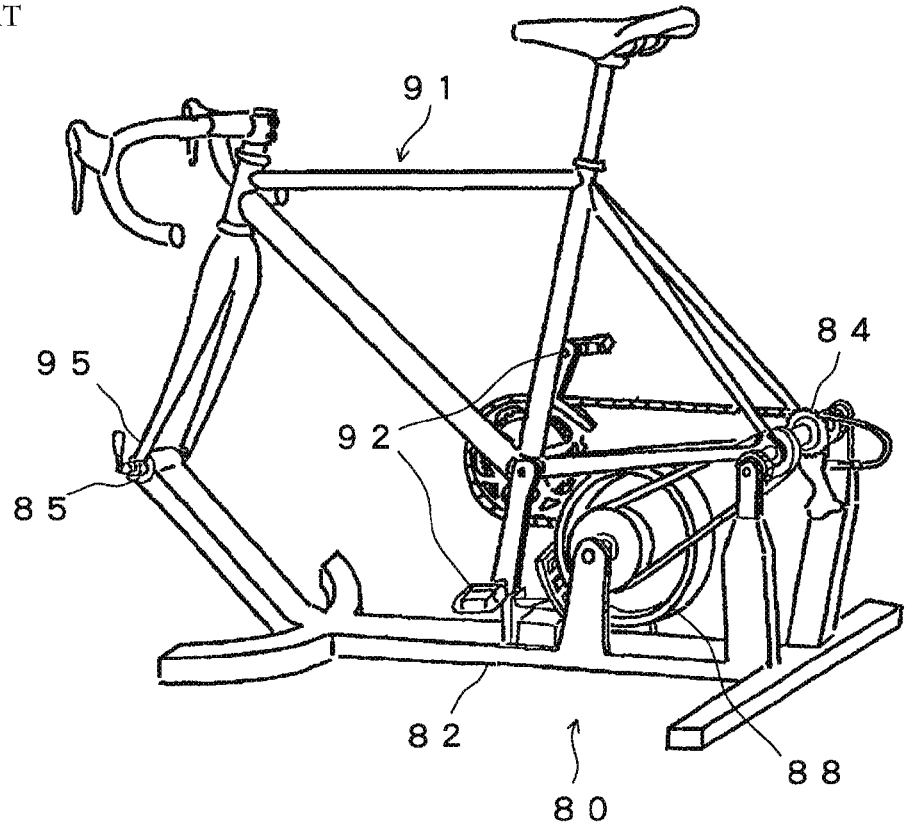
FIG. 9 PRIOR ART
FIG. 9 is an explanatory view to show conventional embodiment.

FIG. 7 shows a part of a support shaft of a bicycle trainer of Example 3. As shown in FIG. 7, the support shaft 25 comprises a support shaft part 35 having a rod shape structure including elastic members 33 and joint parts 31 allocated alternately therealong. The elastic member 33 is made of an elastic material such as a natural rubber or a synthetic rubber. The joint part 31 is made of a metal material such as a stainless steel material and is bonded through adhesion to elastic member 33. In the present example, the elasticity modulus of the elastic materials comprising the elastic members 33 are configured to successively decrease from the body part-side (one end) of the support shaft 25 to the upper side (opposite end) when the support shaft 25 is set on the body part (not shown in the Figure) of the bicycle trainer. The constitution under this invention enables the user to obtain similar swing in back and forth movement and left and right inclination of the bicycle (not shown in the Figure) with less force compared to a bicycle trainer in which a support shaft is composed of an elastic material having the same coefficient of elasticity between the body part-side and the other end thereof.

A bicycle trainer of this invention is not limited to detail descriptions of the preferred embodiment, but is capable of adopting various configurations without deviating from the feature of this specification.

For example, the support shaft 5 may be an elastic member having elasticity such as a spring in Example 1. In addition, the elastic part 9 may be configured to be arranged in the whole hollow part of the frame part 11 in Example 2.

A bicycle trainer of this invention is useful as a training device which enables a user to train enjoying a feeling of actual running outdoors by swinging a bicycle in back and forth movement and left and right inclination in response to force putting a pedal or bending the bicycle left or right in a training indoors, which tends to become tedious with monotonous continuation. Therefore, it is also suitable for a training device for athletes requiring stamina and a strong muscular strength training.

The invention claimed is:

1. A bicycle trainer to enable a user to train with use of a bicycle removably loaded on the bicycle trainer comprising:

a body part placed on a floor;

a support shaft extending longitudinally, one longitudinal end thereof being loosely inserted into the body part and an opposite longitudinal end thereof being fixed to a fork end support unit to support a fork end part of the bicycle; and an elastic part arranged around at least a portion of the support shaft between a longitudinal middle of the support shaft and the opposite end thereof, and wherein shifting of the support shaft by force applied from the fork end part so as to allow the bicycle back and forth movement and left and right inclination is elastically restricted by the elastic part.

2. The bicycle trainer according to claim 1, comprising a frame part internally having a tubular space and vertically arranged to the body part, wherein the elastic part is formed in the tubular space of the frame part, the support shaft is inserted into the tubular space through the elastic part along a longitudinal direction of the frame part, and the opposite end of the support shaft is extended from the frame part.

3. The bicycle trainer according to claim 1, wherein the support shaft is a steel rod or a steel pipe.

4. The bicycle trainer according to claim 1, wherein the support shaft comprises a plurality of elastic members having elasticity.

5. The bicycle trainer according to claim 4, wherein the support shaft comprises a support shaft part having the elastic members spaced by joint parts along the support shaft part with the joint parts being composed of a non-elastic material.

6. The bicycle trainer according to claim 5, wherein the elastic members are of elastic materials, and the elasticity modulus of the elastic materials constituting the elastic members successively decreases from one end of the support shaft to the opposite end thereof.

* * * * *